US005431587A

United States Patent [19]

Matsuoka

[11] Patent Number: 5,431,587

[45] Date of Patent: Jul. 11, 1995

[54] CONTACT IMPLANTING STRUCTURE

[75] Inventor: Noriyuki Matsuoka, Yokohama, Japan

[73] Assignee: Yamaichi Electronics Co., Ltd., Tokyo, Japan

[21] Appl. No.: 307,073

[22] Filed: Sep. 16, 1994

Related U.S. Application Data

[62] Division of Ser. No. 149,920, Nov. 10, 1993, Pat. No. 5,370,559.

[30] Foreign Application Priority Data

Nov. 11, 1992 [JP] Japan ..... 4-327424

[51] Int. Cl.[6] ..... H01R 13/41

[52] U.S. Cl. ..... 439/733.1; 439/78

[58] Field of Search ..... 439/444, 733, 869, 78

[56] References Cited

U.S. PATENT DOCUMENTS

| | | | |
|---|---|---|---|
| 3,696,323 | 10/1972 | Kinkaid et al. | 439/525 |
| 4,157,207 | 6/1979 | Robinson | 439/78 |
| 4,857,001 | 8/1989 | Nakano et al. | 439/78 |
| 4,948,375 | 8/1990 | Lawrence et al. | 439/78 |
| 5,064,391 | 11/1991 | Buchter | 439/733 |

FOREIGN PATENT DOCUMENTS

| | | | |
|---|---|---|---|
| 2260656 | 4/1993 | United Kingdom | 439/444 |

*Primary Examiner*—Gary F. Paumen

*Attorney, Agent, or Firm*—Wenderoth, Lind & Ponack

[57] ABSTRACT

A contact implanting structure including a plurality of contacts each having a pressure-insertion portion provided with an engagement claw projecting therefrom, and a plurality of contact pressure-insertion holes arranged in a row on a base plate formed of an electrically insulative material and adapted to permit the pressure-insertion portions to be inserted therein, the engagement claws of the pressure-insertion portions being caused to bite into walls of the contact pressure-insertion holes respectively, thereby mounting the contacts on the base plate in a row, adjacent the contact pressure-insertion holes being formed such as to have comparatively small and large bores respectively which are different in forward and backward dimension intersecting the direction where the contact pressure-insertion holes are arranged in a row, front walls of the adjacent contact pressure-insertion holes respectively having the comparatively small and large bores being staggered relative to each other, the staggered front walls being served as the walls into which the engagement claws of the pressure-insertion portions of the contacts are caused to bite.

3 Claims, 11 Drawing Sheets

CONTACT IMPLANTING STRUCTURE

This is a Rule 60 Divisional application of Ser. No. 08/149,920, filed Nov. 10, 1994, now U.S. Pat. No. 5,370,559 issued Dec. 6, 1994.

BACKGROUND OF THE INVENTION

This invention relates to a contact implanting structure in which contacts are implanted in a connector board, which is formed of an electric insulative material, in a single row, or double rows or more.

FIG. 16 shows a connector board formed of an electric insulative material used for the conventional contact implanting structure. In FIG. 16(A), contact pressure-insertion holes 92, into which contacts made of metal material, not shown, are implanted under pressure, are arranged in a single row. These contact pressure-insertion holes 92 have equal bores which are equal in rightward and leftward dimension (dimension between opposite surfaces in the arranging direction) and also equal in forward and backward dimension (dimension between opposite surfaces in a direction intersecting the arranging direction), and front walls 93 of the contact pressure-insertion holes 92 are in alignment with rear walls 94 thereof. Pressure-insertion portions of the contacts are forced into the contact pressure-insertion holes 92 respectively, and engagement claws projecting from the pressure-insertion portions are caused to bite into the front walls 93 of the contact pressure-insertion holes 92. In other words, the front walls 93 of the respective contact pressure-insertion holes 92 are served as the walls into which the engagement claws are caused to bite.

In FIG. 16(B), the contact pressure-insertion holes 92 are arranged in two rows on the base plate 91. The contact pressure-insertion holes 92 of the front and rear rows are arranged in such a manner as to be staggered relative to each other, displaying the positional phase by half pitches in the row arranging direction. As in the above example, the contact pressure-insertion holes 92 are formed to have equal bores having equal rightward and leftward dimensions and also equal forward and backward dimensions. The front walls 93 of the contact pressure-insertion holes 92 on the front row are aligned to each other, and the rear walls 94 thereof are also aligned to each other. Likewise, the front walls 93 of the contact pressure-insertion holes 92 on the rear row are aligned to each other, and the rear walls 94 thereof are also aligned to each other.

The pressure-insertion portions of the contacts are forced into the contact pressure-insertion holes 92 on the front and rear rows, and the engagement claws of the pressure-insertion portions are caused to bite into the front walls 93 of the contact pressure-insertion holes 92 on the front and rear rows. In other words, the front walls 93 of the respective contract pressure-insertion holes 92 on the front and rear rows are served as the walls into which the engagement claws are caused to bite.

In the above-mentioned contact implanting structure, the front walls 93 serving as the walls into which the engagement claws are caused to bite are in alignment relative to each other. Recently, in an IC package or the like, with the improvement of the technique of high density integration, there is a tendency the terminal members projecting from the IC package are arranged at very small pitches. In view of this tendency, when the above-mentioned contact implanting structure is employed to a connector such as an IC socket or the like on which the IC package is mounted, it is required to make the distances between the adjacent pressure-insertion holes 92 of the base plate 91 and between the hole front walls 93 short because the IC terminals are arranged at very small pitches. As a result, when the engagement claws are caused to bite into the front walls 93 of the contact pressure-insertion holes 92, or when external force is applied to the implanted contacts, an area between the adjacent contact pressure-insertion holes 92 of the base plate 91 is frequently cracked as indicated by reference numeral 95 of FIGS. 16(A) and 16(B), which results in the problem of inferior implanting. When the cracking 95 is produced, the holding power of the contact pressure-insertion holes 92 to the contacts becomes weak, the contacts are subjected to rattling, and reliable contact with the terminal members of the IC package is unobtainable.

SUMMARY OF THE INVENTION

It is therefore an object of the present invention to provide a contact implanting structure which is capable of preventing a pressure-insertion hole wall from being cracked possibly occurred when a contact is inserted into the contact pressure-insertion hole under pressure, and which is capable of effectively coping with the requirement for arranging terminal members at very small pitches on an electric part such as an IC package or the like.

To achieve the above object, there is essentially provided a contact implanting structure including a plurality of contacts each having a pressure-insertion portion provided with an engagement claw projecting therefrom, and a plurality of contact pressure-insertion holes arranged in a row on a base plate formed of an electrically insulative material and adapted to permit the pressure-insertion portions to be inserted therein, the engagement claws of the pressure-insertion portions being caused to bite into walls of the contact pressure-insertion holes respectively, thereby mounting the contacts on the base plate in a row, adjacent the contact pressure-insertion holes being formed such as to have comparatively small and large bores respectively which are different in forward and backward dimension intersecting the direction where the contact pressure-insertion holes are arranged in a row, front walls of the adjacent contact pressure-insertion holes respectively having the comparatively small and large bores being staggered relative to each other, the staggered front walls being served as the walls into which the engagement claws of the pressure-insertion portions of the contacts are caused to bite.

From another aspect of the present invention, there is provided a contact implanting structure including a plurality of contacts each having a pressure-insertion portion provided with an engagement claw projecting therefrom, and a plurality of contact pressure-insertion holes arranged in a row on a base plate formed of an electrically insulative material and adapted to permit the pressure-insertion portions to be inserted therein, the engagement claws of the pressure-insertion portions being caused to bite into walls of the contact pressure-insertion holes respectively, thereby mounting the contacts on the base plate in a row, adjacent the contact pressure-insertion holes being formed such as to have equal bores respectively which are equal in forward and backward dimension intersecting the direction where the contact pressure-insertion holes are arranged in a row, adjacent front and adjacent rear walls of the contact pressure-insertion holes having equal bores being staggered forwardly and backwardly relative to each other, either of the front and rear walls of the contact pressure-insertion holes having the equal bores being served as the walls into which the engagement claws of the pressure-insertion portions of the contacts are caused to bite.

From still another aspect of the invention, there is provided a contact implanting structure including a plurality of contacts each having a pressure-insertion portion provided with an engagement claw projecting therefrom, and a plurality of contact pressure-insertion holes arranged in a row on a base plate formed of an electrically insulative material and adapted to permit the pressure-insertion portions to be inserted therein, the engagement claws of the pressure-insertion portions being caused to bite into walls of the contact pressure-insertion holes respectively, thereby mounting the contacts on the base plate in a row, adjacent the contact pressure-insertion holes being formed such as to have equal bores respectively which are equal in forward and backward dimension intersecting the direction where the contact pressure-insertion holes are arranged in a row, adjacent front and rear walls of the contact pressure-insertion holes having equal bores being staggered forwardly and backwardly relative to each other, the front and rear walls of the contact pressure-insertion holes having the equal bores being alternately served as the walls into which the engagement claws of the pressure-insertion portions of the contacts are caused to bite.

From yet another aspect of the invention, there is also provided a contact implanting structure including a plurality of contacts each having a pressure-insertion portion provided with an engagement claw projecting therefrom, and a plurality of contact pressure-insertion holes arranged in a row on a base plate formed of an electrically insulative material and adapted to permit the pressure-insertion portions to be inserted therein, the engagement claws of the pressure-insertion portions being caused to bite into walls of the contact pressure-insertion holes respectively, thereby mounting the contacts on the base plate in a row, adjacent the contact pressure-insertion holes being formed such as to have equal bores respectively which are equal in forward and backward dimension intersecting the direction where the contact pressure-insertion holes are arranged in a row, front and rear walls of the contact pressure-insertion holes having equal bores being aligned respectively, the front and rear walls of the contact pressure-insertion holes having the equal bores being alternately served as the walls into which the engagement claws of the pressure-insertion portions of the contacts are caused to bite.

The above and other objects and features of the present invention will be apparent from a reading of the following description taken in conjunction with the accompanying drawings.

BRIEF DESCRIPTION OF THE DRAWINGS

FIG. 6 shows the third embodiment of the present invention.

FIG. 7 shows the fourth embodiment of the present invention.

FIG. 8 shows the fifth embodiment of the present invention.

FIG. 9 shows the sixth embodiment of the present invention.

FIG. 16 shows the prior art.

DETAILED DESCRIPTION OF THE EMBODIMENTS

FIGS. 1 to 6 show the first embodiment of the present invention.

Figure 1:
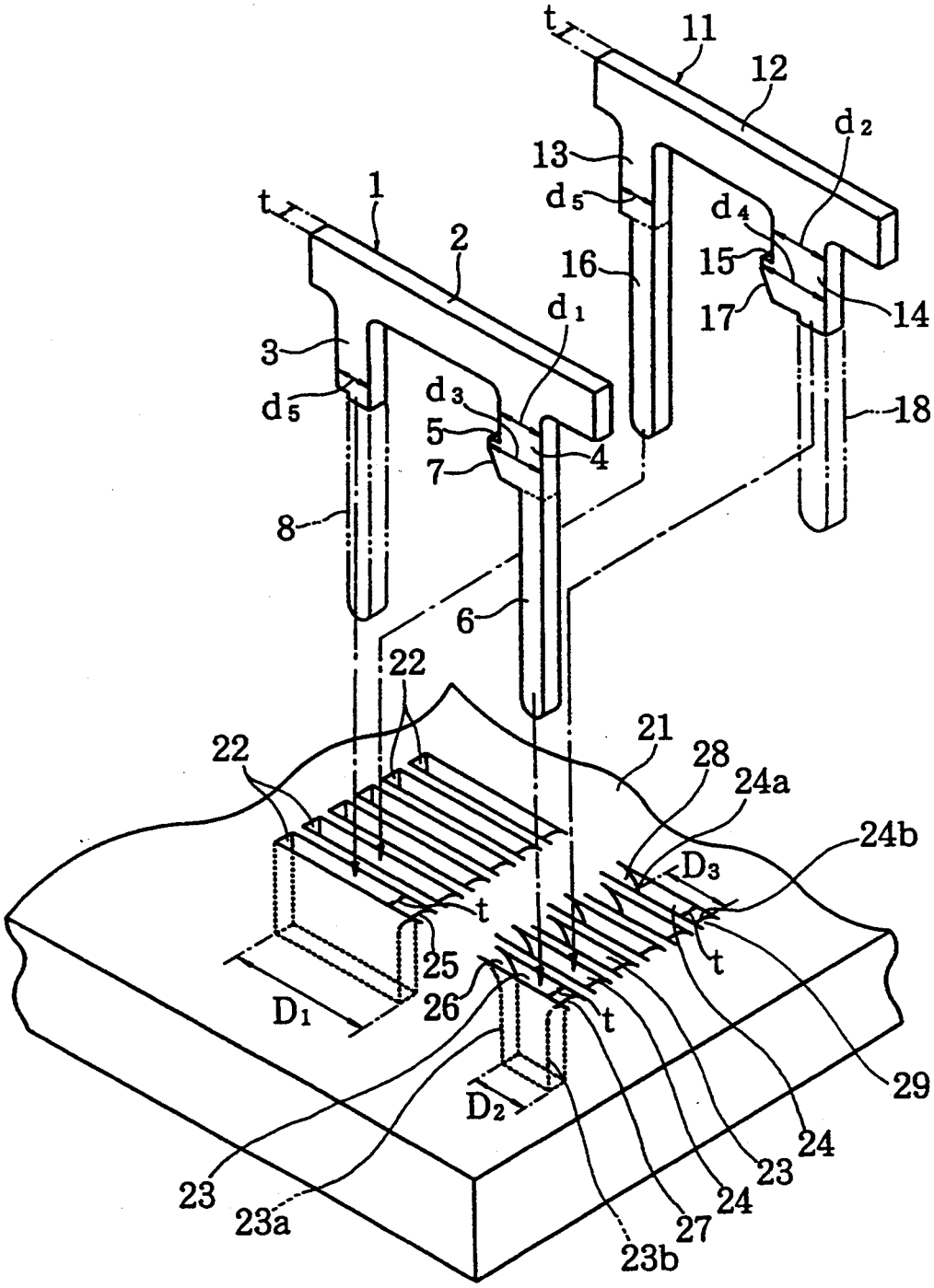
FIG. 1 is an exploded perspective view showing a base plate and contacts according to the first embodiment of the present invention.

In FIG. 1, a first contact 1, which is formed from an electrically-conductive plate material by pressing, comprises an elongated body portion 2 extending in a forward and backward direction, a sway-preventive element 3 extending downward from a front end side of the body portion 2, a pressure-insertion portion 4 extending downward from a rear end side of the body portion 2, an engagement claw 5 projecting toward the front end side from the pressure-insertion portion 4, and a terminal portion 6 continuously extending downward from the pressure-insertion portion 4.

The engagement claw 5 is caused to bite into a front wall 23*a* of a first contact pressure-insertion hole 23, which will be described later, of a base plate 21 by forcing the pressure-insertion portion 4 into the first contact pressure-insertion hole 23. A lower surface of the engagement claw 5 is defined as a slant surface 7 for guiding the pressure-insertion portion 4 into the first contact pressure-insertion hole 23 at the first stage of an inserting operation.

A second contact 11, which is formed likewise from an electrically conductive plate material having the same thickness as the above-mentioned plate material by pressing, comprises an elongated body portion 12 having a generally same configuration as the body portion 2 of the first contact 1, a terminal portion 16 extending downward from a front end side of the body portion 12, a pressure-insertion portion 14 extending downward from a rear end side of the body portion 12, and an engagement claw 15 projecting toward the front end side from the pressure-insertion portion 14. The terminal portion 16 is provided at a basal portion thereof with a sway-preventive element 13 which has the same configuration as the above sway-preventive element 3.

The engagement claw 15 is caused to bite into a front wall 24*a* of a second contact pressure-insertion hole 24, which will be described later, of the base plate 21 by forcing the pressure-insertion portion 14 into the second contact pressure-insertion hole 24. A lower surface of the engagement claw 15 is defined as a slant surface 17 for guiding the pressure-insertion portion 14 into the second contact pressure-insertion hole 24 at the first stage of an inserting operation.

A forward-and-backward dimension length $d_1$ of the pressure-insertion portion 4 of the first contact 1 at a basal portion of the engagement claw 5 is smaller than a forward-and-backward dimension length $d_2$ of the pressure-insertion portion 14 of the second contact 11 ( $d_1<d_2$ ).

In the first and second contacts 1 and 11, as shown by the imaginary lines of FIG. 1, instead of the terminal portion 6 extending from the pressure-insertion portion 4 of the first contact 1, there may be provided a terminal portion 8 extending from the sway-preventive element 3 of the first contact 1, and instead of the terminal portion 16 extending from the sway-preventive element 3 of the second contact 11, there may be provided a terminal portion 18 extending from the pressure-insertion portion 14 of the second contact 11.

in a first pressing process for forming the first and second contact, the terminal portions 6, 8, 16 and 18 are provided on the sway-preventive elements 3 and 13 and the pressure-insertion portions 4 and 14, respectively, and then in the second pressing process, either the terminal portions 6 and 16 or the terminal portions 8 and 18 are cut off to form the first and second contacts having the above-mentioned configurations.

The base plate 21, on which the first and second contacts 1 and 11 are to be implanted and which is formed from an electrically insulative material by molding, comprises a plurality of insertion holes 22 which are formed all the way through the base plate 21 and through which the sway-preventive elements 3 and 13 are loosely inserted, and contact pressure-insertion holes 23 and 24 respectively having a comparatively small bore and a comparatively large bore, which are formed all the way through the base plate 21 and into which the pressure-insertion portions 4 and 14 are forced.

The insertion holes 22 are arranged in a row in the rightward and leftward direction. A rightward and leftward dimension t of each insertion hole 22 is generally equal to a plate thickness t of a component material of each contact, while a dimension $D_1$ of each insertion hole 22 in the forward and backward direction is larger than a forward and backward dimension $d_5$ of any of the sway-preventive elements 3 and 13. The respective holes 22 are equal in bore to each other, and an inlet of a rear end of each insertion hole 22 is defined as an arcuate surface 25.

On the other hand, the contact pressure-insertion holes 23 each having a comparatively small bore and the contact pressure-insertion holes 24 each having a comparatively large bore are alternatively arranged in a row in the rightward and leftward direction behind the insertion holes 22. A rightward and leftward dimension t of any of the contact pressure-insertion holes 23 and 24 is generally equal to the plate thickness t of the component material of each contact. A forward and backward dimension $D_2$ of each contact pressure-insertion hole 23 having a comparatively small bore is different from a forward and backward dimension $D_3$ of each contact pressure-insertion hole 24 having a comparatively large bore.

Concretely, the forward and backward dimension $D_2$ of each contact pressure-insertion hole 23 having a comparatively small bore is larger than the forward and backward dimension $d_1$ of the basal portion of the pressure-insertion portion 4 in the first contact 1 but smaller than the forward and backward dimension $d_3$ of the pressure-insertion portion 4 including the engagement claw 5 ($d_1<d_2<d_3$).

The forward and backward dimension $D_3$ of each contact pressure-insertion hole 24 having a comparatively large bore is larger than the forward and backward dimension $d_2$ of the basal portion of the pressure-insertion portion 14 in the second contact 11 but smaller than the forward and backward dimension $d_4$ of the pressure-insertion portion 14 including the engagement claw 15 ($d_2<d_3<d_4$).

The inlets of front and rear ends of the contact pressure-insertion holes 23 and 24 are defined as arcuate surfaces 26, 27, 28 and 29, respectively, for guiding the first and second contacts 1 and 11 when they are implanted.

Figure 2:
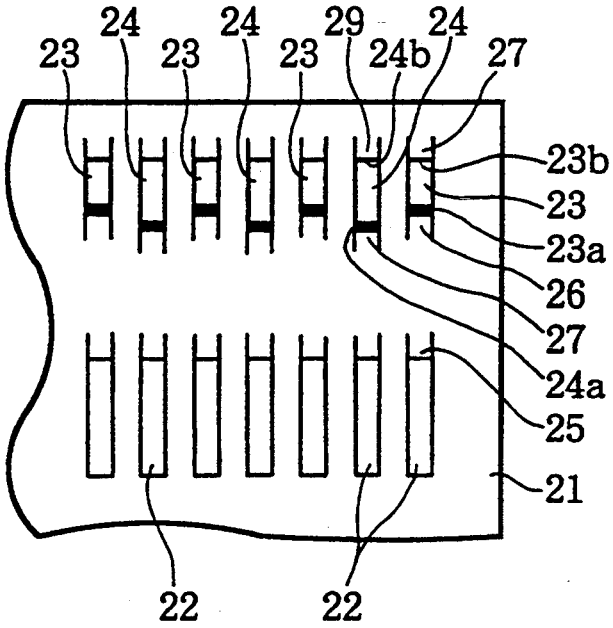
FIG. 2 is a plan view of the above base plate.

FIG. 2 shows a plan view of the base plate 21. In FIG. 2, the front walls 23*a* of the contact pressure-insertion holes 23 and the front walls 24*a* of the contact pressure-insertion holes 24 are not in alignment. In other words, the front walls 23*a* are staggered forwardly and backwardly relative to the adjacent front walls 24*a* respectively. As shown by thick lines of FIG. 2, the front walls 23*a* and 24*a* respectively constitute the walls into which the engagement claws 5 and 15 in the first and second contacts 1 and 11 are caused to bite.

The rear walls 23*b* and 24*b* of the contact pressure-insertion holes 23 and 24 are in alignment so as to serve as positioning walls, respectively.

Figure 3:
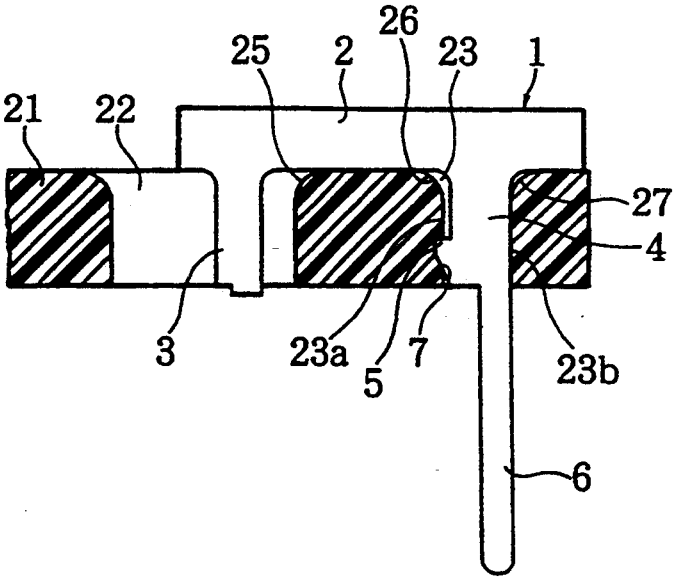
FIG. 3 is a sectional view showing a first contact implanted in the base plate.

In this first embodiment, for implanting the first contact 1 into the base plate 21, the terminal portion 6 of the first contact 1 is inserted into the contact pressure-insertion hole 23 from above and at the same time, the sway-preventive element 3 is inserted into that insertion hole 22 which corresponds to the contact pressure-insertion hole 23. Then, the pressure-insertion portion 4 is forced into the contact pressure-insertion hole 23 with a rear surface of the pressure-insertion portion 4 allowed to contact the rear wall 23*b* of the contact pressure-insertion hole 23. That is, the pressure-insertion portion 4 is forced into the contact pressure-insertion hole 23, with the slant surface 7 of the engagement claw 5 abutted against the arcuate surface 26 of the contact pressure-insertion hole 23. When the pressure-insertion portion 4 is further forced into the contract pressure-insertion hole 23, the engagement claw 5 bites into the front wall 23*a* of the contact pressure-insertion hole 23. As shown in FIG. 3, when the body portion 2 of the first contact 1 is brought into abutment against the upper surface of the base plate 21, the insertion of the terminal portion 6 of the first contact 1 is completed. Although the sway-preventive element 3 of the of the first contact 1 is loosely fitted into the contact insertion hole 22 in the forward and backward direction, it is restricted by the opposite right and left side walls of the contact insertion hole 22.

Likewise, for implanting the second contact 11 into the base plate 21, the terminal portion 16 and sway-preventive element 13 of the second contact 11 are inserted into that contact pressure-insertion hole 23 which corresponds to the contact pressure-insertion hole 24 from above. Then, the pressure-insertion portion 14 is forced into the contact pressure-insertion hole 24 with a rear surface of the pressure-insertion portion 14 allowed to contact the rear wall 24*b* of the contact pressure-insertion hole 24.

Figure 4:
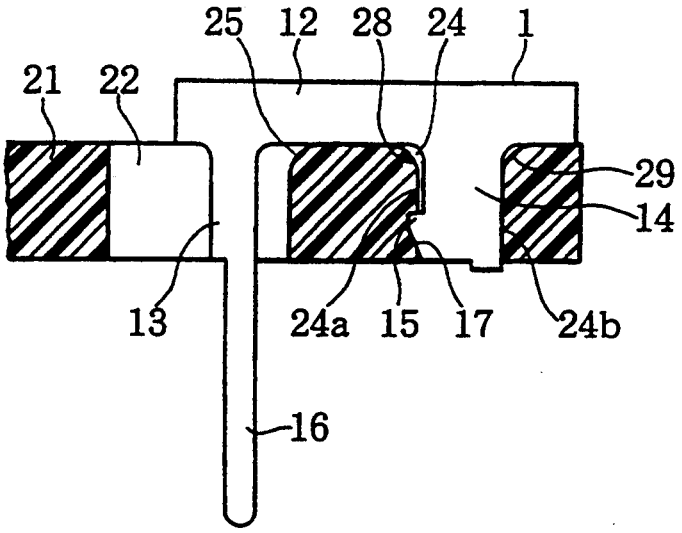
FIG. 4 is likewise a sectional view but showing a second contact implanted in the base plate.

That is, the pressure-insertion portion 14 is forced into the contact pressure-insertion hole 24, with the slant surface 17 of the engagement claw 15 abutted against the arcuate surface 28 of the contact pressure-insertion hole 24 and further pushed down in that condition. By reaction thereof, the rear surface of the pressure-insertion portion 14 is brought into intimate contact with the rear wall 24*b* and the engagement claw 15 bites into the front wall 24*a* of the contact pressure-insertion hole 24. As shown in FIG. 4, when the body portion 12 of the second contact 11 is brought into abutment against the upper surface of the base plate 21, the insertion of the terminal portion 16 of the second contact 11 is completed.

Although the sway-preventive element 13 of the of the second contact 11 is loosely fitted into the contact insertion hole 22 in the forward and backward direction, it is sandwiched between and restricted by the opposite right and left side walls of the contact insertion hole 22.

According to the first embodiment, as shown in FIG. 2, since the adjacent front walls 23*a* and 24*a* of the contact pressure-insertion holes 23 and 24 are staggered forwardly and backwardly relative to each other, the distance between the front wall 23*a* and the front wall 24*a* becomes long compared with the conventional device in which the front walls are aligned and therefore the rigidity of that portion of the base plate 21 between the adjacent front walls 23*a* and 24*a* is increased. Since the pressure-insertion portions 4 and 14 are forced into the contact pressure-insertion holes 23 and 24 respectively and the engagement claws 5 and 15 are caused to bite into the adjacent front walls 23*a* and 24*a* which are staggered forwardly and backwardly relative to each other, that portion of the base plate 21 between the adjacent front walls 23*a* and 24*a* can be prevented from being cracked by pressure during the implanting of the contact or by external force after the completion of the implanting. Thus, the first and second contacts can be firmly mounted on the base plate 21. Furthermore, the contact pressure-insertion holes 23 and 24 can be arranged at smaller pitches.

Moreover, since the rear walls 23*b* and 24*b* of the contact pressure-insertion holes 23 and 24 are in alignment so as to be served as positioning walls, a positioning operation can easily be made when the first and second contacts 1 and 11 are automatically implanted into the base plate 21 by a robot, for example.

Furthermore, since the sway-preventive elements 3 and 13 are inserted into the insertion holes 22, respectively, the first and second contacts 1 and 11 can be prevented from being laterally swayed and therefore the load to be applied to the pressure-insertion portions 4 and 14 can be reduced.

Other embodiments of the present invention will now be described with reference to FIGS. 5 to 9.

Figure 5:
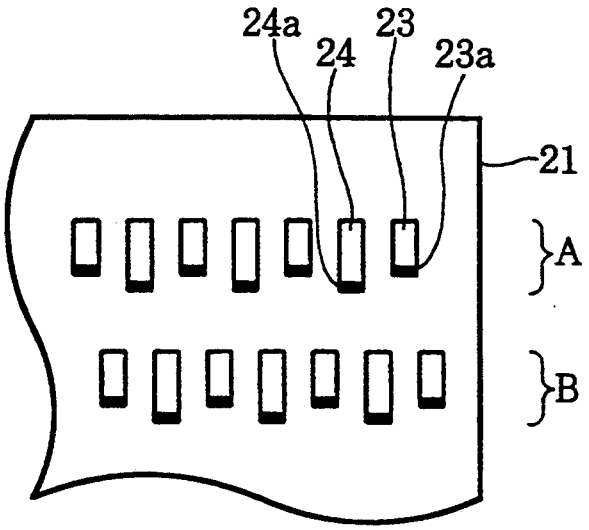
FIG. 5 is a plan view showing a base plate according to the second embodiment of the present invention.

FIG. 5 shows the second embodiment, in which unitary rows A and B of the contact pressure-insertion holes 23 and 24 of the first embodiment, respectively having comparatively small and large bores, are arranged in two rows, one row in the front and the other in the back, and the contact insertion-holes 23 and 24 on the unitary rows A and B are positionally displaced rightwardly and leftwardly by half pitches. The remaining construction of the pressure-insertion holes 23 and 24 are the same as the first embodiment.

Figure 6A:
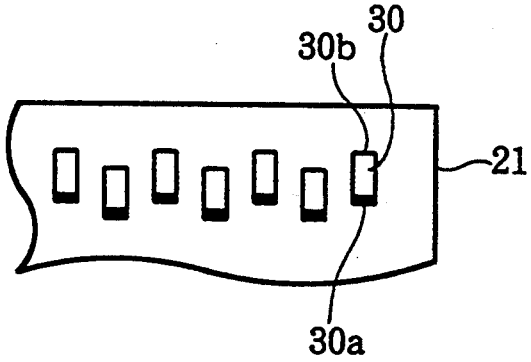
FIG. 6(A) is a plan view of a base plate on which contact pressure-insertion holes are arranged in a row.
Figure 6B:
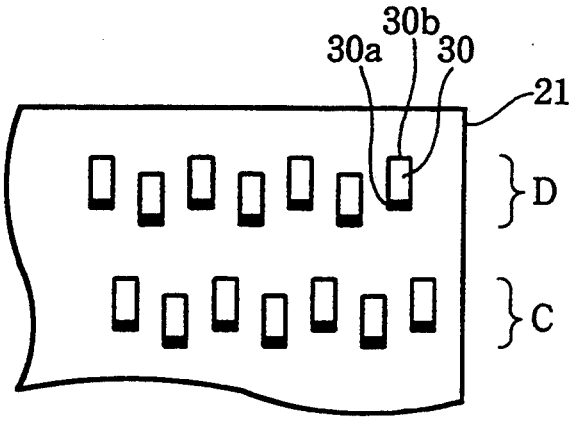
FIG. 6(B) is likewise a plan view of a base plate on which contact pressure-insertion holes are arranged in two rows.

FIGS. 6(A) and 6(B) show the third embodiment, FIG. 6(A) is an example in which the contact pressure-insertion holes 30 arranged in a row are formed to have equal bores (i.e., rightward and leftward dimensions are equal and forward and backward dimensions are equal), the adjacent front walls 30*a* are staggered forwardly and backwardly relative to each other and the adjacent rear walls 30*b* are staggered forwardly and backwardly relative to each other, and the front walls 30*a* of the contact pressure-insertion holes 30 having equal bores are served as the walls into which the engagement claws are caused to bite.

In another example shown in FIG. 6(B), unitary rows C and D of the contact pressure-insertion holes having equal bores of FIG. 6(A) are arranged in two rows, one row in the front and the other in the back, and the contact pressure-insertion holes 30 having equal bores on the unitary rows C and D are positionally displaced by half pitches.

Figure 7A:
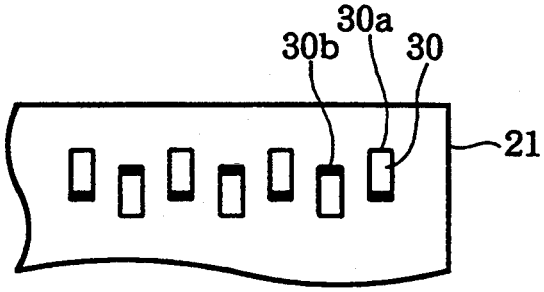
FIG. 7(A) is a plan view of a base plate on which contact pressure-insertion holes are arranged in a row.
Figure 7B:
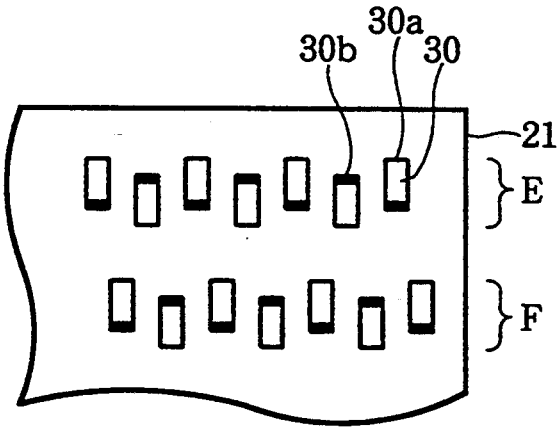
FIG. 7(B) is likewise a plan view of a base plate on which contact pressure-insertion holes are arranged in two rows.

FIGS. 7(A) and 7(B) show the fourth embodiment, FIG. 7(A) is an example in which the contact pressure-insertion holes 30 having equal bores arranged in a row are arranged such that their adjacent front walls 30*a* are staggered forwardly and backwardly relative to each other and their adjacent rear walls 30*b* are likewise staggered forwardly and backwardly relative to each other, and the front walls 30*a* and rear walls 30*b* of the contact pressure-insertion holes 30 having equal bores are alternately served as the walls into which the engagement claws are caused to bite, and FIG. 7(B) is another example in which unitary rows E and F of the contact pressure-insertion holes 30 having an arrangement as explained with respect to FIG. 7(A) are positionally displaced in two rows, one row in the front and the other in the back, by half pitches.

Figure 8A:
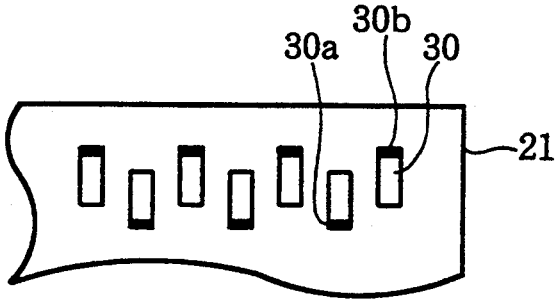
FIG. 8(A) is a plan view of a base plate on which contact pressure-insertion holes are arranged in a row.
Figure 8B:
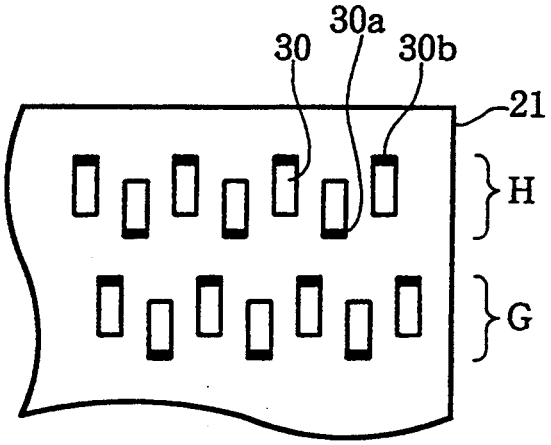
FIG. 8(B) is likewise a plan view of a base plate on which contact pressure-insertion holes are arranged in two rows.

FIGS. 8(A) and 8(B) show the fifth embodiment of the present invention, in which the contact pressure-insertion holes 30 are formed to have equal bores (i.e., the rightward and leftward dimensions are equal to each other and the forward and backward dimensions are also equal to each other), the adjacent front walls 30*a* and the adjacent rear walls 30*b* of the contact pressure-insertion holes 30 are staggered forwardly and backwardly relative to each other, respectively, and the front walls 30*a* and rear walls 30*b* of the contact pressure-insertion holes 30 are alternately served as the walls into which the engagement claws 5 and 15 of the pressure insertion portions 4 and 14 are caused to bite. FIG. 8(A) shows an example in which the contact pressure-insertion holes 30 are arranged in a single row, and FIG. 8(B) shows another example in which the contact pressure-insertion holes 30 are arranged in double rows (H, G).

Figure 9A:
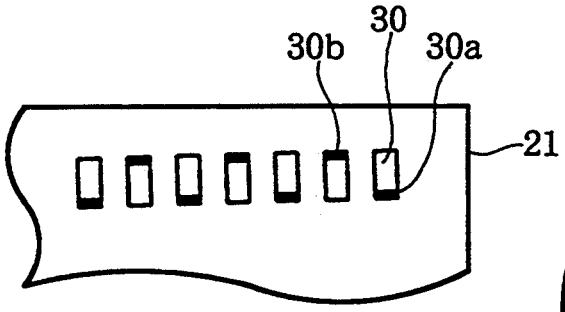
FIG. 9(A) is a plan view of a base plate on which contact pressure-insertion holes are arranged in a row.
Figure 9B:
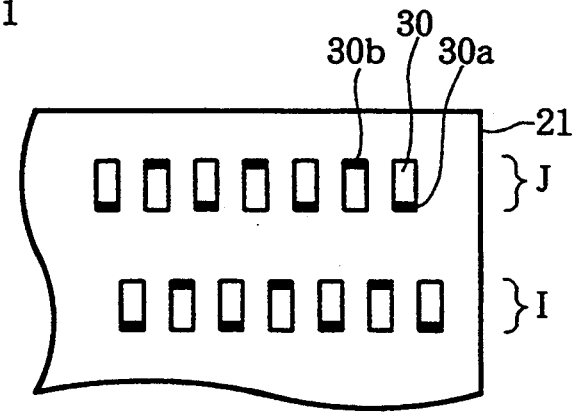
FIG. 9(B) is likewise a plan view of a base plate on which contact pressure-insertion holes are arranged in two rows.

FIGS. 9(A) and 9(B) show the sixth embodiment of the present invention. FIG. 9(A) shows an example in which the front walls 30*a* and rear walls 30*b* of the contact pressure-insertion holes 30 having equal bores arranged in a single row are aligned to each other, and the front and rear walls 30*a* and 30*b* are alternately served as the walls into which the engagement claws are caused to bite. FIG. 9(B) shows another example in which two of such single rows I and J of the contact pressure-insertion holes 30 having the equal bores are arranged in two rows, one row in the front and the other in the back.

Next, one example, in which the contact implanting structure of the first embodiment is applied to an upper surface contact type IC socket, will be described with reference to FIGS. 10 to 14.

Figure 10:
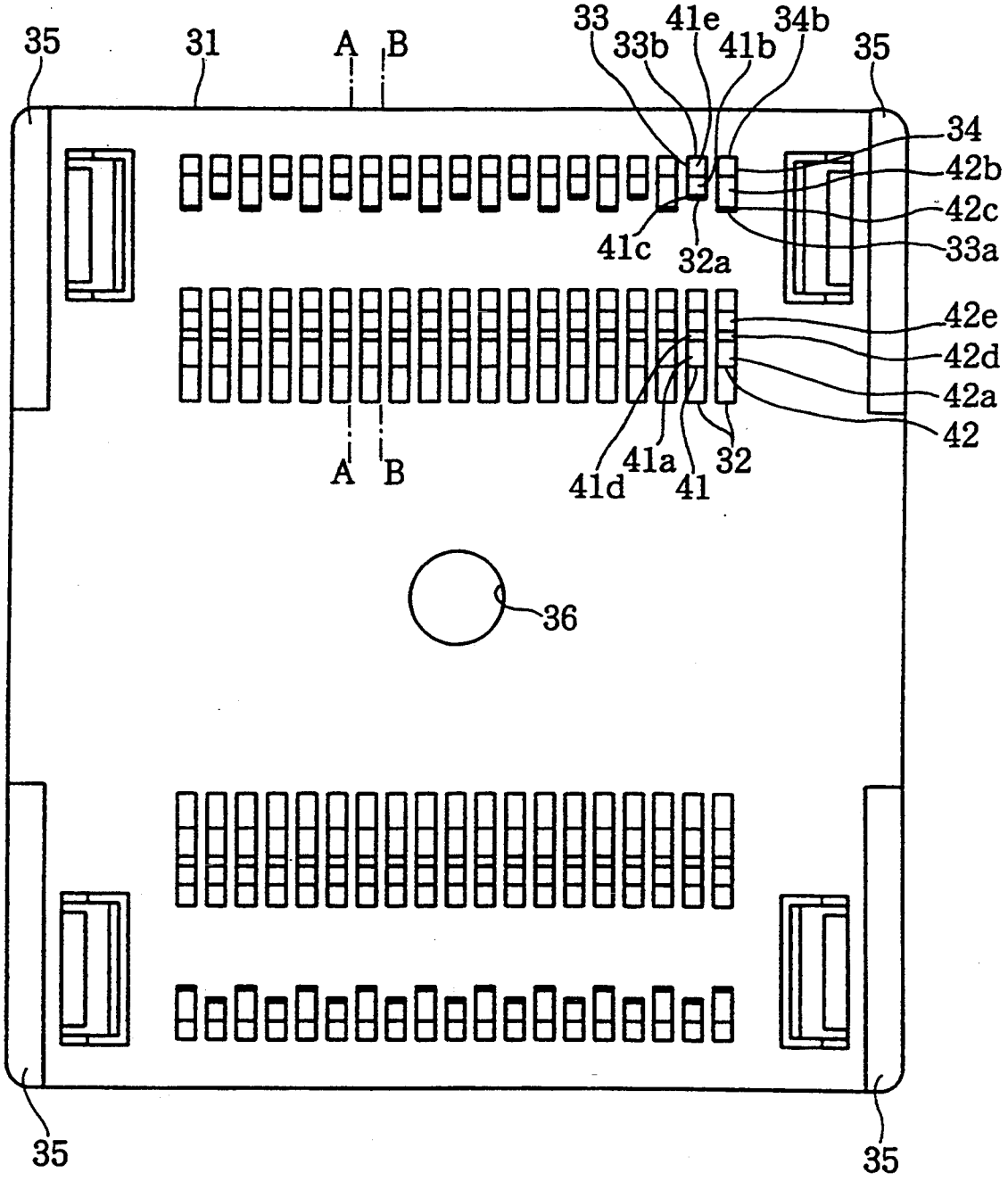
FIG. 10 is a bottom view of a socket board in which a contact implanting structure of the present invention is employed.

FIG. 10 is a bottom view of an IC socket in which first and second contacts 41 and 42 formed from an electrically conductive material by pressing are implanted in a generally square socket body formed from an electrically insulative material by molding. The socket body 31 is provided at opposite front and rear edge portions thereof with the rows of insertion holes 32 of the sway-preventive elements and the rows of contact pressure-insertion holes 33 and 34 respectively having comparatively large and small bores, respectively, as in the case with the first embodiment.

While inserting male terminal portions 41*e* and 42*e* projecting downward from rear end sides of supporting plate portions 41*a* and 42*a* of the first and second contacts 41 and 42 respectively into the contact pressure-insertion holes 33 and 34, pressure-insertion portions 41*b* and 42*b* respectively formed on basal portions of these male terminal portions 41*e* and 42*e* are forced therein, so that engagement claws 41*c* and 42*c* respectively projecting from the pressure-insertion portions 41*b* and 42*b* may bite into front walls 33*a* and 33*b* which are arranged at front and rear portions of the contact pressure-insertion holes 33 and 34 in such a manlier as to be staggered forwardly and backwardly relative to each other. Rear walls 33*b* and 34*b* aligned to each other are served as positioning walls of the pressure-insertion portions 41*b* and 42*b* of the first and second contacts 41 and 42.

Inserted respectively into the insertion holes 32 of the socket board 31 are sway-preventive elements 41*d* and 42*d* extending downward from front end sides of the supporting plate portions 41*a* and 42*a* of the first and second contacts 41 and The socket board 31 is provided at four corners thereof with one each of standoffs which are adapted to form gaps between a printed board not shown and the standoffs when the socket board 31 is mounted on the printed board. An IC package receiving portion 36 having an open top is formed in a central area of the socket board 31.

In FIG. 10, the terminal portion 41*e* extends downward continuously from the pressure-insertion portion 41*b* of the first contact 41, and the terminal portions 42*e* extends downward continuously from the sway-preventive element 42*b* of the second contact 42.

Figure 11:
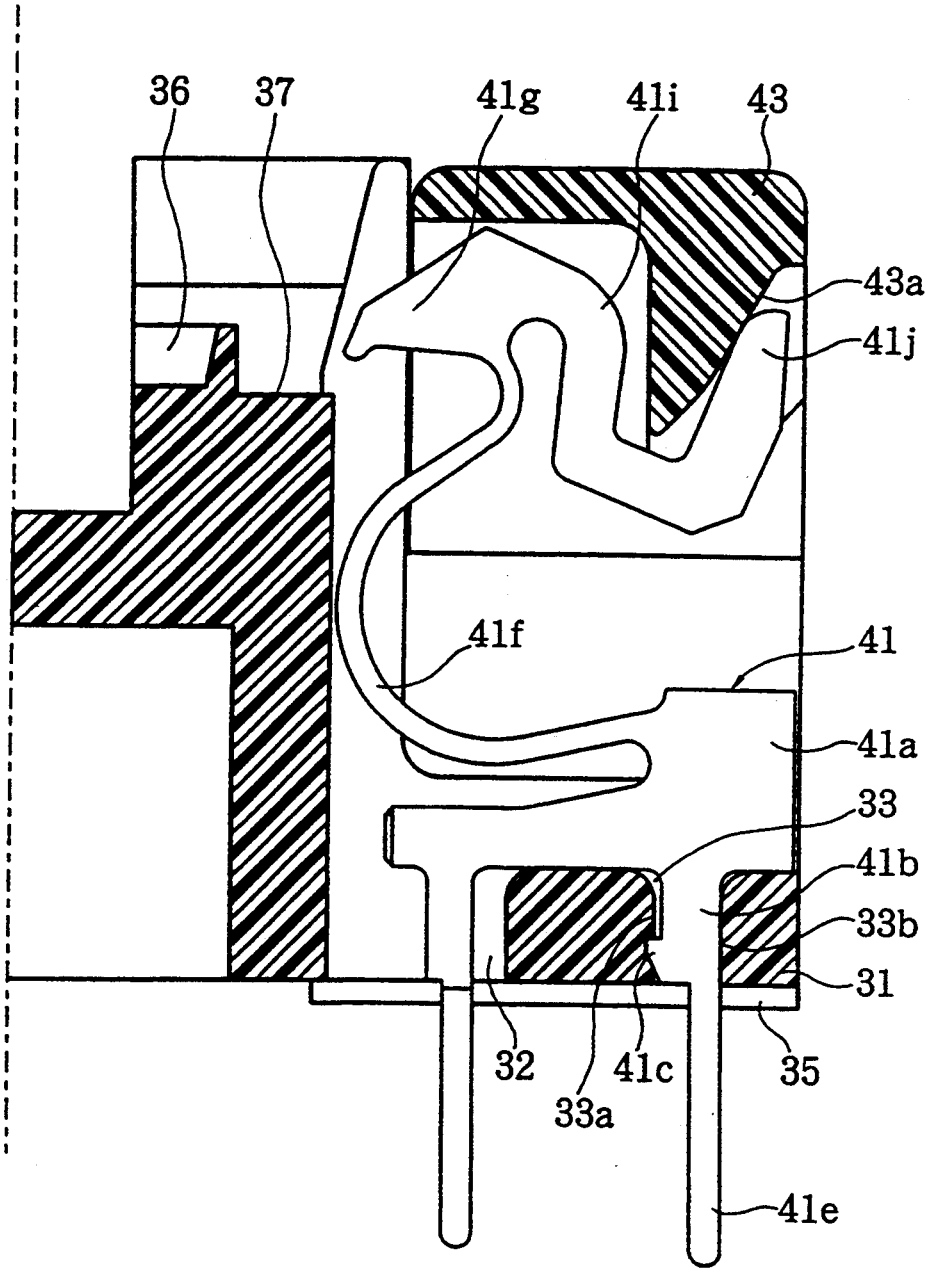
FIG. 11 is a sectional view taken on line A—A of FIG. 10, showing the first contact now in a disengaging position.
Figure 12:
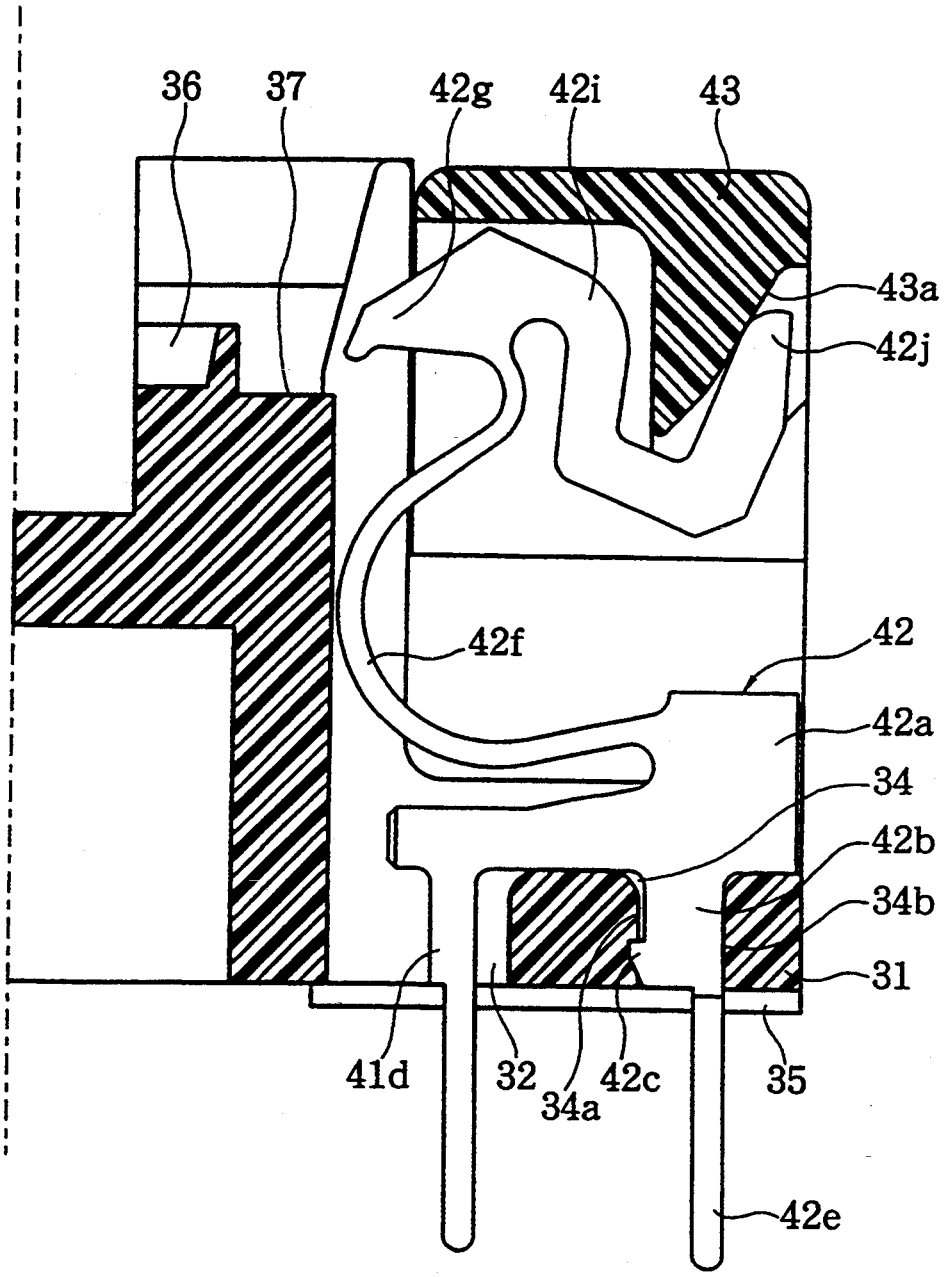
FIG. 12 is a sectional view taken on line B—B of FIG. 10, showing the second contact now in a disengaging position.

FIG. 11 is a sectional view in which a pressure receiving portion 41*j* of the first contact 41 implanted in the socket board 31 is in a depressed condition by a contact shutter member 43, and FIG. 12 is a sectional view in which a pressure receiving portion 42*j* of the second contact 42 implanted in the socket board 31 is in a depressed condition by the contact shutter member 43. The first and second contacts 41 and 42 implanted in the socket board 31 are arranged along one side wall of the IC package receiving portion 36 which is disposed on an upper surface side of the socket board 31. The first and second contacts 41 and 42 respectively include generally semi-arcuate curved spring portion portions 41*f* and 42*f* which respectively project upwardly and forwardly (toward the IC package receiving portion 36 side) from the supporting plate portions 41*a* and 42*a*. Rigid contacting pieces 41*g* and 42*g* project forwardly respectively from upper ends of the curved spring portions 41*f* and 42*f*, and rigid arm portions 41*i* and 42*i* project respectively from rearward positions of the contacting pieces 41*g* and 42*g*. Pressure receiving portions 41*j* and 42*j* project upwardly respectively from rear ends of the arm portions 41*i* and 42*i*. The frame-like contact shutter member 43 vertically movably overlies the socket board 31. A slant surface 43*a* of the contact shutter member 43 is supported on the pressure receiving portions 41*j* and 42*j*. The arrangement being such that when the contact shutter member 43 is lowered, obliquely downwardly directing force is applied to the pressure receiving portions 41*j* and 42*j*.

By this downward force, the arm portions 41*i* and 42*j* are pivoted downward about the upper ends of the curved spring portions 41*f* and 42*f* against the resilient force of the curved spring portion 41*f* and 42*f*. And by reaction thereof, the contacting pieces 41*g* and 42*g* are obliquely upwardly and downwardly pivoted about the upper ends of the curved spring portions 41*f* and 42*f*, respectively, thereby realizing a contact-releasing or contact-removal condition.

Figure 13:
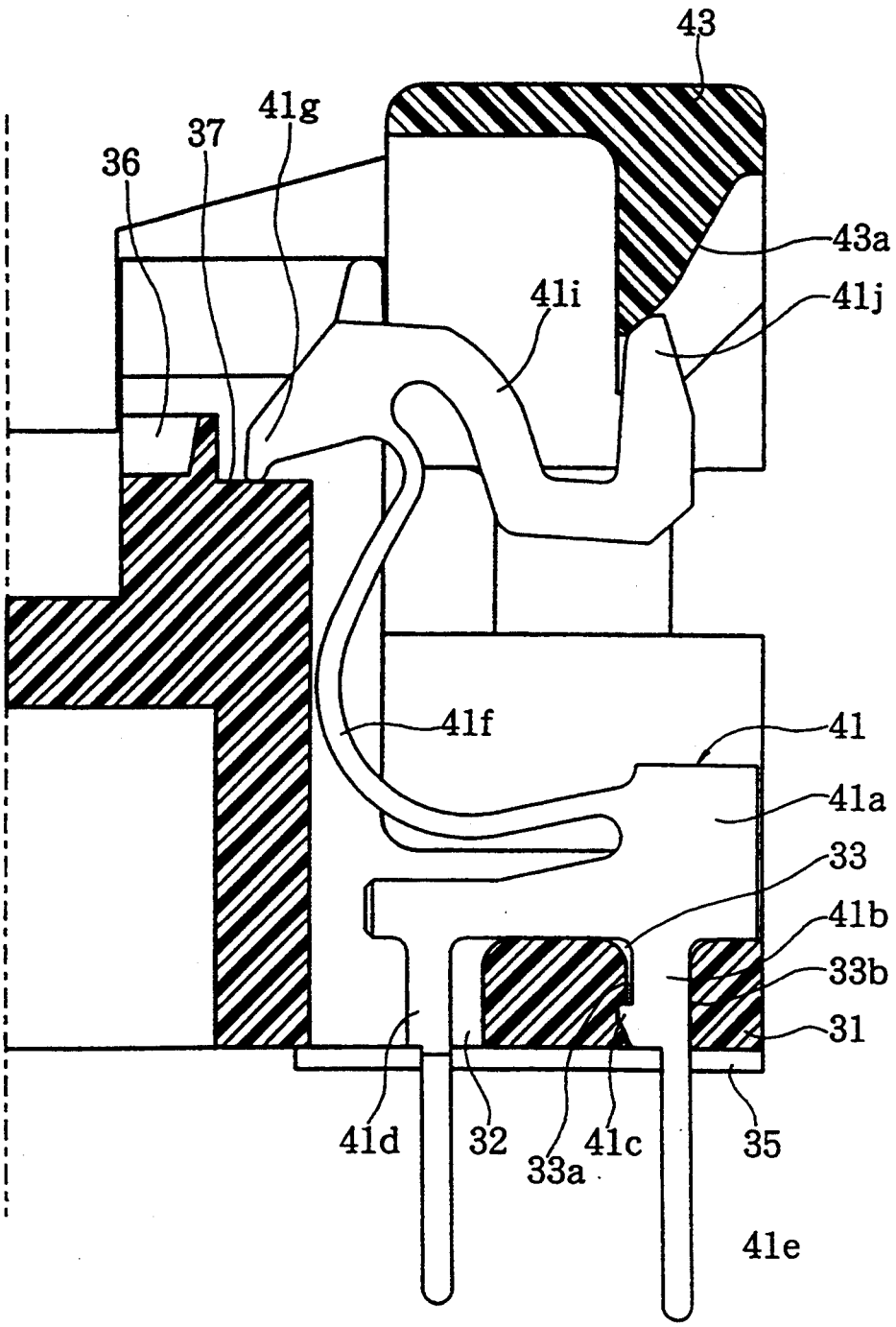
FIG. 13 is a sectional view taken on A—A of FIG. 10, showing the first contact now in an engaging position.
Figure 14:
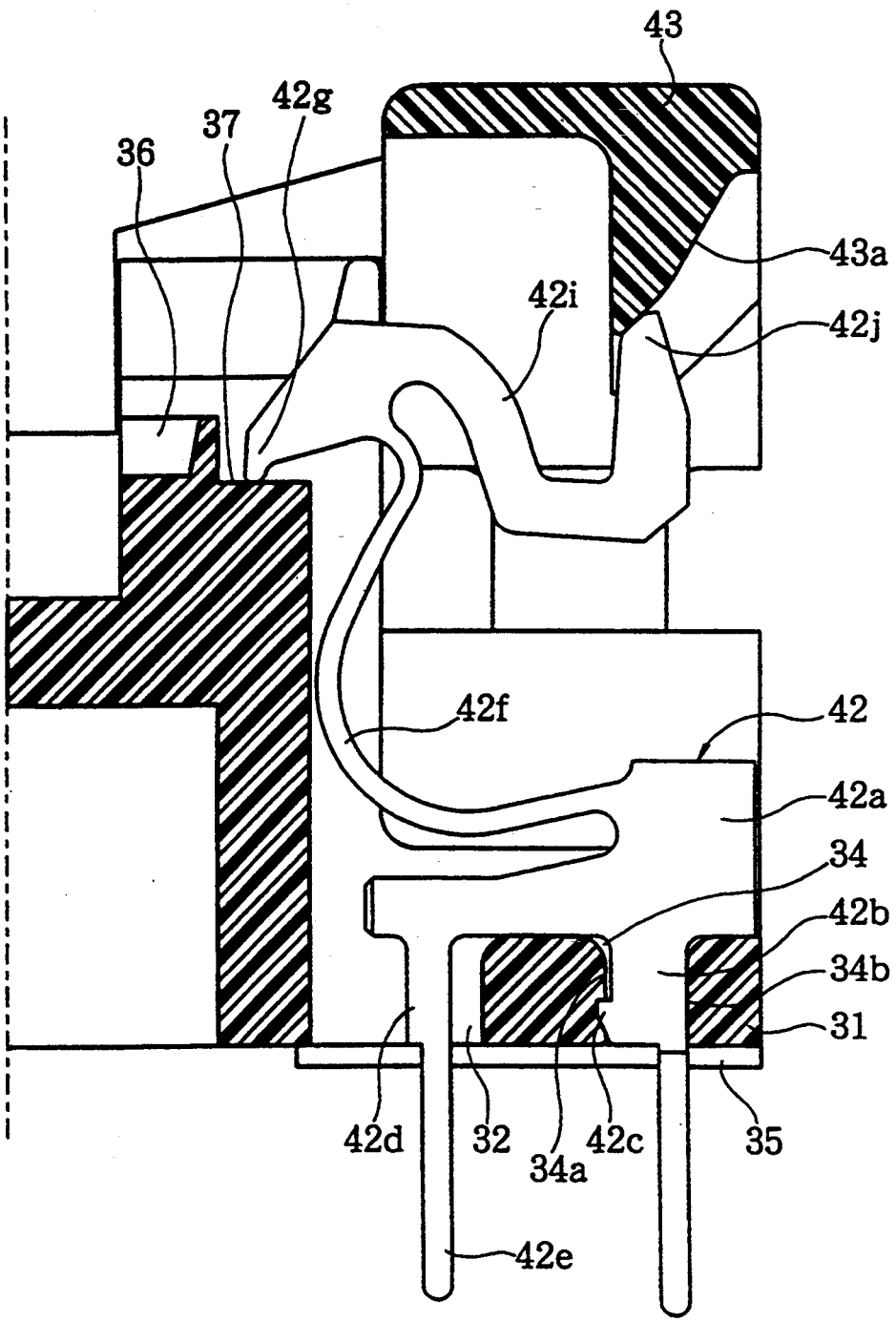
FIG. 14 is a sectional view taken on B—B of FIG. 10, showing the second contact now in an engaging position.

FIG. 13 is a sectional view in which the depressing force of the contact shutter member 43 to the first contact 41 is removed. FIG. 14 is a sectional view in which the depressing force of the contact shutter member 43 to the second contact 42 is removed. When the depressing force to the second contact 42 is removed as in FIG. 14, the contact shutter member 43 is lifted upwardly by restoring force of the contact. At the same time the contacting pieces 41*g* and 42*g* are pivoted downward by restoring resiliency of the curved spring portions 41*f* and 42*f*, and the contacting pieces 41*h* and 42*h* are moved obliquely downwardly from above and brought into abutment with the terminal supporting surface 37 of the socket board 31, with the curved spring portions 41*f* and 42*f* still maintaining the remaining restoring resiliency. The IC package is received in the IC receiving portion 36, its terminal is supported on the terminal supporting surface 37 and the contact pieces 41*g* and 42*g* are brought into pressure contact with the upper surface of the terminal, which is supported on the terminal supporting surface 37, by forwardly directing restoring force.

Also in the upper surface contact type IC socket shown in FIGS. 10 to 14, the adjacent front walls 32*a* and 33*a* of the contact pressure-insertion holes 32 and 33 respectively having comparatively small and large bores formed in the socket board 31 are staggered forwardly and backwardly relative to each other. Accordingly, even if large depressing force is acted on the first and second contacts when they are depressed by the contact shutter member 43, the area between the front walls 32*a* and 33*a* of the socket board 31 can effectively be prevented from being cracked.

Figure 15:
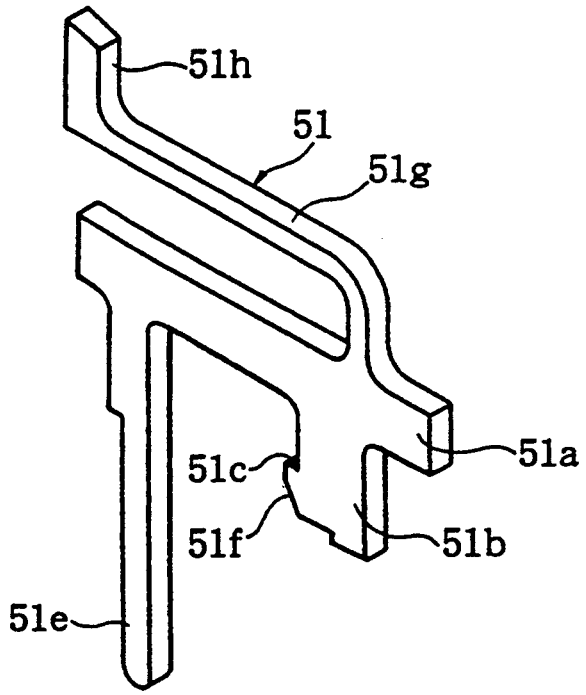
FIG. 15 is a perspective view of another example of a contact to which the contact implanting structure of the present invention is applicable.
Figure 16A:
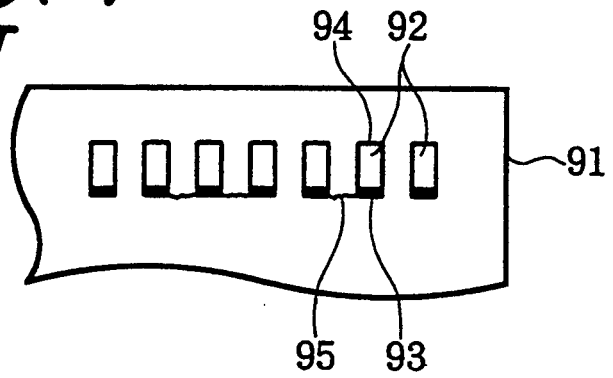
FIG.16(A) PRIOR ART
FIG. 16(A) is a plan view of a base plate on which contact pressure-insertion holes are arranged in a row.
Figure 16B:
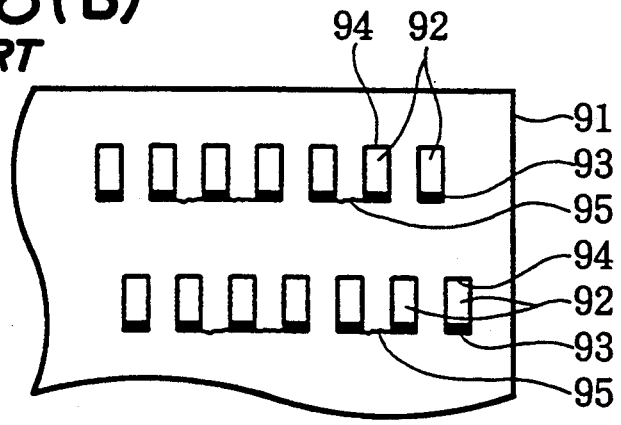
FIG.16(B) PRIOR ART
FIG. 16(B) is a plan view of a base plate on which contact pressure-insertion holes are arrange in two rows.

FIG. 15 shows a contact 51 which is used for a lower surface contact type IC socket. This contact 51, which is formed from an electrically conductive material by pressing, includes a laterally elongated seat element 51*a*, an pressure-insertion portion 51*b* extending downwardly from one end side of the seat element 51*a*, an engagement claw 51*c* projecting from the pressure-insertion portion 51*b*, a terminal portion 51*e* extending downwardly from the other end side of the seat element 51*a*, a horizontal U-shaped contact arm portion 51*g* formed of a spring element extending toward the other end side from an upper portion of one end side of the seat element 51*a*, and a contacting portion 51*h* projecting upwardly from a leading end of the contacting arm portion 51*g*. The pressure-insertion portion 51*b* of this contact 51 is forced into the pressure-insertion hole of the above-mentioned embodiments. Also in this case, vertical load is applied to the contacting arm portion 51*g*, and therefore a possible breakage of the pressure-insertion hole due to this load can effectively prevented.

The present invention includes a case where the term "front wall or walls" used in connection with the above respective embodiments are referred to as "rear wall or walls", and the term "rear wall or walls" as "front wall or walls".

According to the present invention, in a contact implanting structure in which the pressure-insertion portion of each contacts is forced into the contact pressure-insertion hole arranged in the base plate formed of electrical insulative material in a connector such as an IC socket, or the like, and the engagement claw of this pressure-insertion portion is caused to bite into either the front or rear wall of the contact pressure-insertion portion, the adjacent wall surfaces of the contact pressure-insertion holes into which the engagement claw is caused to bite are staggered forwardly and backwardly relative to each other. Accordingly, the area between the pressure-insertion holes can effectively prevented from being cracked by pressure applicable when the contacts are implanted or by external force repeatedly applied to the contacts after being implanted, the implanting strength of the contacts relative to the base plate can be increased, and more reliable contact between the contact and the electric part is ensured. In addition, the pressure-insertion holes can be arranged at very small pitches, thus enabling to effectively cope with the requirement for arranging the terminals at very small pitches in an IC package or the like.

While specific embodiments of the invention have been shown and described in detail to illustrate the application of the principles of the invention, it will be understood that the invention may be embodied otherwise without departing from such principles.

What is claimed is:

1. A contact implanting structure including a plurality of contacts each having a pressure-insertion portion provided with an engagement claw projecting therefrom, and a plurality of contact pressure-insertion holes arranged in a row on a base plate formed of an electrically insulative material and adapted to permit said pressure-insertion portions to be inserted therein, said engagement claws of said pressure-insertion portions being caused to bite into walls of said contact pressure-insertion holes respectively, thereby mounting said contacts on said base plate in a row, adjacent said contact pressure-insertion holes being formed such as to have equal bores respectively which are equal in length in a first direction normal to the direction where said contact pressure-insertion holes are arranged in a row, adjacent front and adjacent rear walls of said contact pressure-insertion holes being staggered forwardly and backwardly relative to each other in said first direction, either of said front and rear walls of said contact pressure-insertion holes serving as said walls into which said engagement claws of said pressure-insertion portions of said contacts are caused to bite.

2. A contact implanting structure including a plurality of contacts each having a pressure-insertion portion provided with an engagement claw projecting therefrom, and a plurality of contact pressure-insertion holes arranged in a row on a base plate formed of an electrically insulative material and adapted to permit said pressure-insertion portions to be inserted therein, said engagement claws of said pressure-insertion portions being caused to bite into walls of said contact pressure-insertion holes respectively, thereby mounting said contacts on said base plate in a row, adjacent said contact pressure-insertion holes being formed such as to have equal bores respectively which are equal in length in a first direction normal to the direction where said contact pressure-insertion holes are arranged in a row, adjacent front and rear walls of said contact pressure-insertion holes being staggered forwardly and backwardly relative to each other in said first direction, said front and rear walls of said contact pressure-insertion holes alternately serving as said walls into which said engagement claws of said pressure-insertion portions of said contacts are caused to bite.

3. A contact implanting structure including a plurality of contacts each having a pressure-insertion portion provided with an engagement claw projecting therefrom, and a plurality of contact pressure-insertion holes arranged in a row on a base plate formed of an electrically insulative material and adapted to permit said pressure-insertion portions to be inserted therein, said engagement claws of said pressure-insertion portions being caused to bite into walls of said contact pressure-insertion holes respectively, thereby mounting said contacts on said base plate in a row, adjacent said contact pressure-insertion holes being formed such as to have equal bores respectively which are equal in length in a first direction normal to the direction where said contact pressure-insertion holes are arranged in a row, front and rear walls of said contact pressure-insertion holes being aligned respectively, said front and rear walls of said contact pressure-insertion holes alternately serving as said walls into which said engagement claws of said pressure-insertion portions of said contacts are caused to bite.

* * * * *